US007322577B1

(12) United States Patent
Jaimes-Ojeda

(10) Patent No.: US 7,322,577 B1
(45) Date of Patent: Jan. 29, 2008

(54) BOARD GAME AND METHOD TO PLAY

(76) Inventor: Vladimir Jaimes-Ojeda, Urb. Campo Alegre, Calle 114, Edif. Palma de Oro, Torre 3, Planta Baja No. 1, Valencia, Carabobo (VE) 33179

( * ) Notice: Subject to any disclaimer, the term of this patent is extended or adjusted under 35 U.S.C. 154(b) by 150 days.

(21) Appl. No.: 11/352,484

(22) Filed: Feb. 13, 2006

(51) Int. Cl.
*A63F 3/00* (2006.01)

(52) U.S. Cl. ..... 273/274; 273/236; 463/16
(58) Field of Classification Search ..... 273/236, 273/274; 463/16–22
See application file for complete search history.

(56) References Cited

U.S. PATENT DOCUMENTS

2002/0070500 A1* 6/2002 Au-Yeung ..... 273/292
2005/0261045 A1* 11/2005 Harris ..... 463/13

* cited by examiner

*Primary Examiner*—Vishu K. Mendiratta
(74) *Attorney, Agent, or Firm*—Albert Bordas, P.A.

(57) ABSTRACT

A board game and method to play that includes a board, green numbered pieces, a card set, and a point chip set for both adults and children, wherein players make logical decisions based on the possibilities of gaining or losing points. There could be different figures and/or diagrams on the card set, depending on whether the board game is intended for child and/or adult players. In the preferred embodiment, the board game is played by two or more players, and up to twelve players in total. The player who is able to accumulate the highest amount of points is the winner.

13 Claims, 3 Drawing Sheets

BOARD GAME AND METHOD TO PLAY

BACKGROUND OF THE INVENTION

1. Field of the Invention

The present invention relates to games, and more particularly, to board games.

2. Description of the Related Art

Several designs for board games have been designed in the past. None of them, however, include a board, green numbered pieces, a card set, and a point chip set for both adults and children, wherein players make logical decisions based on the possibilities of gaining or losing points. The player who is able to accumulate the highest amount of points is the winner. No other board games suggest the novel features of the present invention.

SUMMARY OF THE INVENTION

The present application is a didactic game that entertains and allows kids and adults to participate in a dynamic way. While playing, players have to make logical decisions that affect their possibilities of winning and/or losing points. The winner is determined to be the player who accumulates the highest amount of points. The instant invention is intended for players from the age of six years and older. There could be different figures and/or diagrams on the card set, depending on whether the board game is intended for child and/or adult players. In the preferred embodiment, the board game is played by two or more players, and up to twelve players in total.

It is therefore one of the main objects of the present invention to provide a board game and method to play for entertainment.

It is therefore one of the main objects of the present invention to provide a board game and method to play for learning mathematical principles.

It is another object of this invention to provide a board game and method to play for children and adults that requires players to make logical decisions in order to win.

It is yet another object of this invention to provide such a board game that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
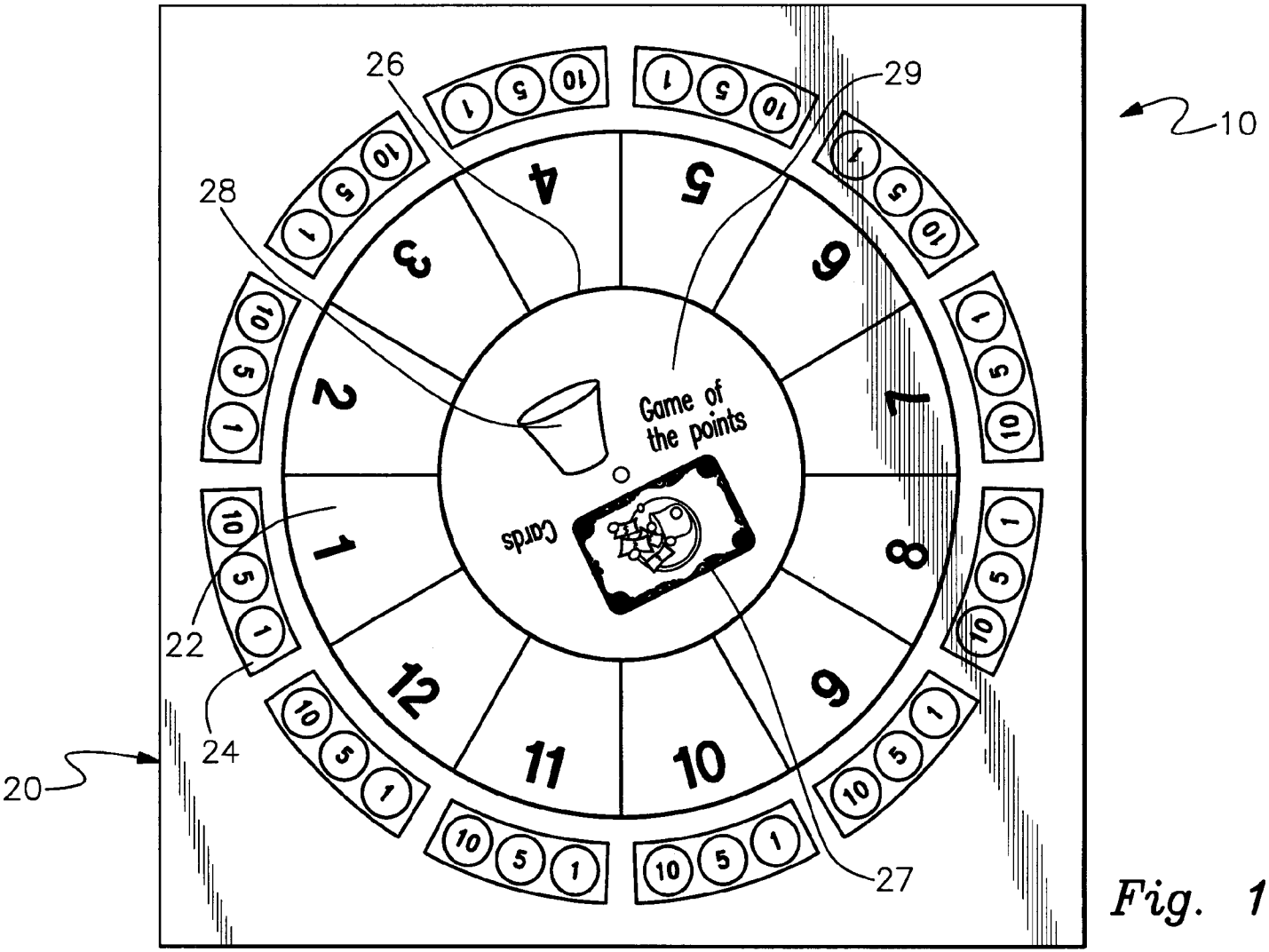
FIG. 1 represents a perspective view of the board game.

Referring now to the drawings, the present invention is defined as a board game and method to play. The board game is generally referred to with numeral 10 and it can be observed that it basically includes board 20, green numbered pieces 40, card set 60, and point chip set 80.

As shown in FIG. 1, board game 10 comprises board 20. Board 20 has multiple spaces for different purposes. Centrally disposed on board 20 is an area defined as central circular portion 26. Within central circular portion 26 are cards space 27 on one half of the area with the word "Cards" written next to it. Also within central circular portion 26 is pot of fortune space 28, and free space 29. Extending outwardly from central circular portion 26 are twelve numbered player position spaces 22. In the preferred embodiment, each player position space 22 is pie-shaped and establishes the position for each player, with a maximum of twelve players playing a game. Positioned outwardly from player position spaces 22 are point section spaces 24 numbered. Each point section space 24 comprises three spaces that illustrate a numerical value of "1"; "5" and "10".

Figure 2:
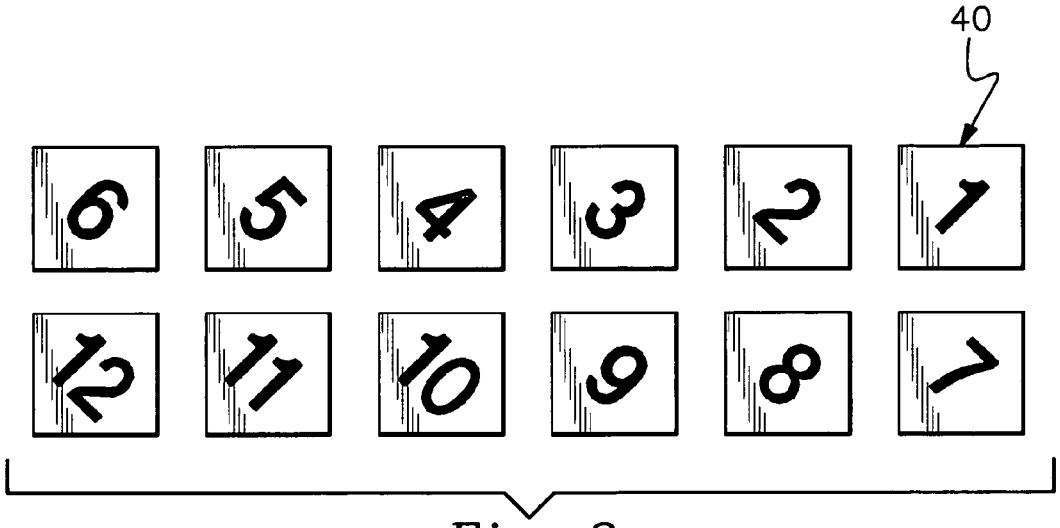
FIG. 2 illustrates green numbered pieces numbered from one to twelve that are used with the board game.

As seen in FIG. 2, green numbered pieces 40 are substantially square in shape. In the preferred embodiment, there are twelve green numbered pieces 40 corresponding for up to twelve players, numbered 1; 2; 3; 4; 5; 6; 7; 8; 9; 10; 11; and 12. Green numbered pieces 40 are used by the players to establish the position of the players for the game.

Figure 3:
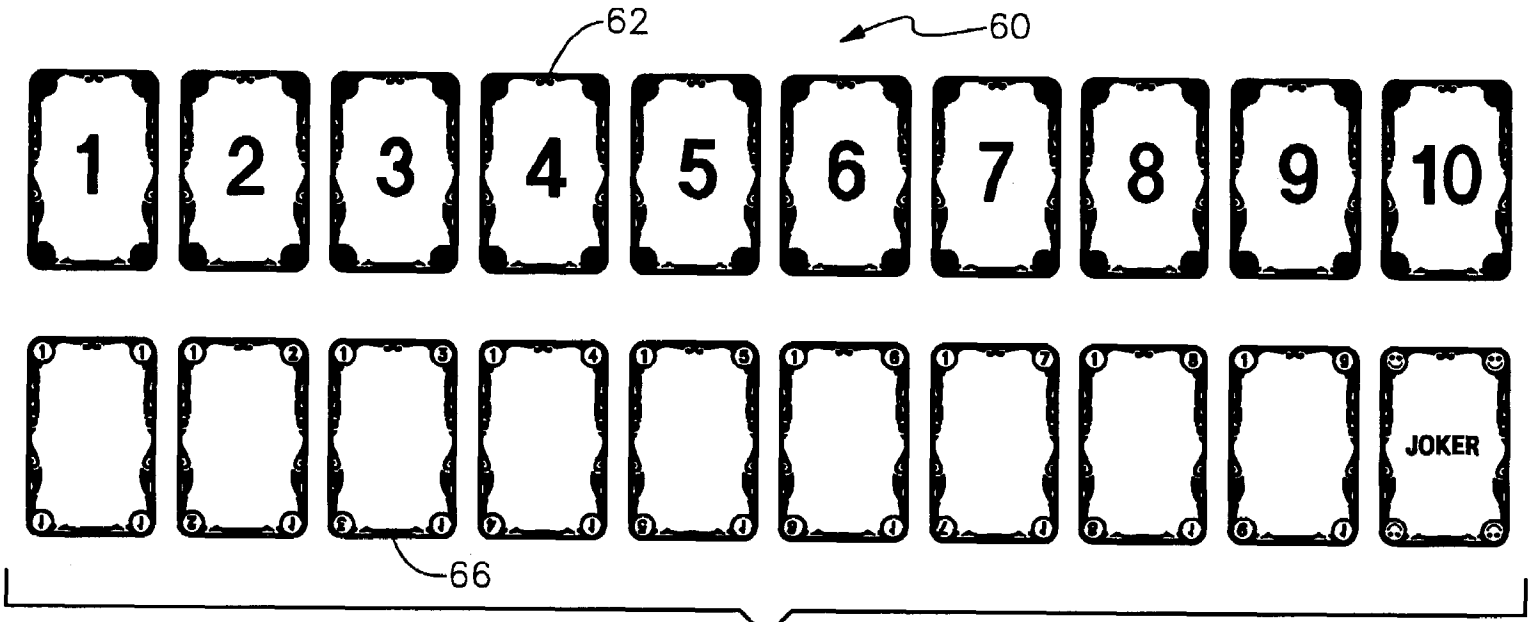
FIG. 3 illustrates green and purple cards used in the board game, each one is shown face down and face up to show an example of the possible illustrations.

As seen in FIG. 3, card set 60 are substantially rectangular in shape. Card set 60 comprises green cards 62 and purple cards 66. In the preferred embodiment, there are forty-six green cards 62 in four identical sets of ten cards. The ten cards are numbered from one to ten and there are six wild cards. In the preferred embodiment, there are forty purple cards 66 in four identical sets of ten cards, numbered 1-1; 1-2; 1-3; 1-4; 1-5; 1-6; 1-7; 1-8; 1-9 and 1-10.

Figure 4:
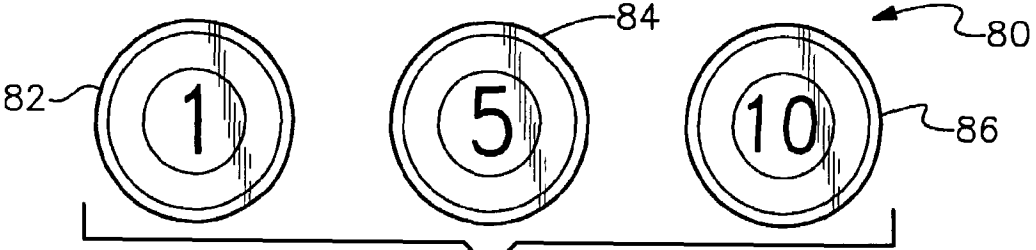
FIG. 4 illustrates a purple chip (worth 1 point), a green chip (worth 5 points) and a blue chip (worth 10 points).

As seen in FIG. 4, point chip set 80 comprises circular shaped purple chips 82, green chips 84 and blue chips 86. The numerical values on point chip set 80 represent points and are used for waging during play.

There are a total of two hundred eighty eight individual chips that make up point chip set 80. The summation of the numerical values of point chip set 80 equate to one thousand two hundred points distributed as follows: One hundred twenty purple chips 82 with a value of one point each; one hundred twenty green chips 84 with a value of five points each, for a total of six hundred points; and forty-eight blue chips 86 with a value of ten points each, for a total of four hundred eighty (480) points.

Rules of the Board Game

A cycle is defined as when all players have played one turn.

Green cards 62 and purple cards 66 cannot be reorganized or changed during the game.

Once the wage is placed, players may not retract it.

Chips from chip set 80 may not be lent to other players for waging.

Players are not allowed to wage an amount of points greater than they have accumulated or an amount of points greater than that in the pot of fortune space 28. For example, if a player has a point chip set 80 in the amount of forty points and the pot of fortune space 28 has a total of fifty points, the player can wager up to the forty points accumulated.

No player can withdraw a wage after the green card 62 is revealed.

If a player decides to quit the game, chips from point chip set 80 cannot be distributed, unless consented to and distributed equally amongst all the remaining players.

A player's purple card 66 cannot be shown until their respective turn during play.

Before each turn, the majority of all the players must agree upon the wage to be made from point chip set 80 by players before each turn A player is eliminated from the game when all the chips from the respective player's point chip set 80 are depleted.

Starting Play

Green numbered pieces 40 are shuffled and placed with the numerical values facing downwardly onto free space 29.

Each player selects one of the green numbered pieces 40. The numerical value of the green numbered pieces 40 corresponds to the player position space 22 that the player will assume for play.

The player with the lowest numerical value corresponding to player position space 22 starts the game.

The player positioned to the left, corresponding to an ascending number on player position space 22, follows in turn.

The player with the highest numerical value corresponding to player position space 22 is the dealer of card set 60. The responsibility of the dealer includes shuffling and distributing cards from card set 60 to the players.

Each player is given a predetermined equal amount of point chip set 80 to be placed on their respective player point section space 24 corresponding to the to player position space 22.

Each player places at least one purple chip 82 in the pot of fortune space 28. Players can agree an a predetermined numerical value of point chip set 80 to place in pot of fortune space 28.

The dealer shuffles green cards 62 and stacks them facing downwardly on cards space 27.

The dealer shuffles purple cards 66 and distributes one to each player. The players should not view their purple cards 66 before their turn.

The player at turn views their purple card 66 and chooses whether to play or not.

If the player chooses not to play, the player misses the turn. The player has the option to not play, or passing, if the player determines that the purple card 66 has a low probability of winning. For example, purple cards 66 with ranges of 1-1, 1-2, and 1-3 offer the player low chances of winning. Then, the player to his/her left is next in turn.

If the player chooses to play, the player determines how much of their accumulated chips from point chip set 80 to wage. The determination of waging is based upon the value on the purple card 66 that will be numbered 1-1; 1-2; 1-3; 1-4; 1-5; 1-6; 1-7; 1-8; 1-9 and 1-10.

After waging, the dealer distributes one of green cards 62 to the player at turn and a determination is made as to whether the player won or lost the wage made.

To win, the numerical value shown on the green card 62 must be within the range of the numerical value shown in the purple card 66. For example, assuming purple card 66 shows the numerical value "1-7" and the green card 62 shows the numerical value "5", since "5" falls in between the range "1-7", the player wins.

If the player won, the player takes an amount equivalent to the player's wage from the pot of fortune space 28. If the player waged the same amount of points that was in the pot of fortune space 28, the player takes all the points from the pot of fortune space 28 and starts a new cycle where every player places at least one purple chip 82 (or the previously agreed amount of points) in pot of fortune space 28. The player that won becomes the dealer and the player to his/her left is next in turn.

If however, the green card 62 is a wild card, or the numerical value of the green card 62 is outside the range of the numerical value shown in the purple card 66, the player loses. For example, assuming purple card 66 shows the numerical value "1-7" and the green card 62 shows the numerical value "8", since "8" falls outside the range "1-7", the player loses. Another example of the player losing, assuming purple card 66 shows the numerical value "1-7" and the green card 62 shows the numerical value "1", since "1" is not in between the range "1-7" the player loses. Yet another example of the player losing, assuming purple card 66 shows the numerical value "1-7" and the green card 62 shows the numerical value "7", since "7" is not in between the range "1-7" the player loses.

If the player lost, the player places the wage into the pot of fortune space 28 and the player to his/her left is next in turn.

When all players have played one turn, a cycle is complete and a new cycle starts. A new cycle starts regardless of whether or not there are still chips from point chip set 80 accumulated in pot of fortune space 28, due to the fact that nobody won those chips or because of chip waging. Before starting a new cycle, all players place at least one purple chip 82, or the previously agreed amount of chips, in pot of fortune space 28. This procedure is repeated every time a new cycle is started.

The player with the greatest summation of the numerical values of point chip set 80 at the end of the game is the winner.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A method of playing a board game, comprising the steps of:

A) shuffling and placing numbered pieces having first numerical values facing downwardly onto a board;

B) selecting one of said numbered pieces by each player to establish said player playing position and dealer;

C) distributing a predetermined equal amount of chips from a point chip set and placing on a first space of said board for each of said player, said chips having second numerical values;

D) placing at least one of said chips by each of said player on said board;

E) shuffling and placing by said dealer first cards facing downwardly on said board, each of said first cards illustrating third numerical values;

F) shuffling and distributing by said dealer second cards to each of said player, each of said player not viewing their respective said second card before their turn, each of said second cards illustrating a numerical range;

G) viewing by each of said player at turn their respective said second card and choosing whether to play said turn or not;

H) choosing not to play said turn, said player misses said turn;

I) choosing to play said turn, said player determines how much of accumulated said chips to wage;

J) waging by said player at said turn;

K) distributing by said dealer one of said first cards to said player at said turn;

L) determining whether said player at said turn won or lost said wage made, said won occurs when said third numerical values on said first card is within said numerical range of said second card and said player takes an amount equivalent to said wage from said board, if said player waged an equivalent said second numerical value as in said first space, said player takes all said chips from said first space and starts a new cycle wherein each of said player places at least one said chips on said first space and said player that won becomes said dealer and a player to left is next in turn, said lost occurs when said first card is a wild card, or said third numerical value of said first card is outside said numerical range of said second card and said player places said wage into said first space and a player to said left is next in turn;

M) completing a cycle and each of said player places said at least one said chip onto said first space; and N) winning a game when one of said player accumulates greatest summation of said second numerical values on said chips.

2. The method of playing a board game set forth in claim 1, further characterized in that said first and second cards cannot be reorganized or changed during said game.

3. The method of playing a board game set forth in claim 1, further characterized in that once said wage is placed, said players may not retract it.

4. The method of playing a board game set forth in claim 1, further characterized in that said chips from said chip set may not be lent to other said players for waging.

5. The method of playing a board game set forth in claim 1, further characterized in that said players are not allowed to said wage a said second numerical value greater than they have accumulated or an amount greater than that in said first space.

6. The method of playing a board game set forth in claim 1, further characterized in that no said player can withdraw said wage after said first card is revealed.

7. The method of playing a board game set forth in claim 1, further characterized in that said if one of said players decides to quit the game, said chips from said point chip set cannot be distributed, unless consented to and distributed equally amongst all the remaining said players.

8. The method of playing a board game set forth in claim 1, further characterized in that before each said cycle, a majority of said players must agree upon said wage to be made by said players before each said turn.

9. The method of playing a board game set forth in claim 1, further characterized in that said player is eliminated from said game when all said chips from respective said player are depleted.

10. The method of playing a board game set forth in claim 1, further characterized in that said numbered pieces are twelve in total and have said first numerical values from one to twelve.

11. The method of playing a board game set forth in claim 1, further characterized in that said chips total two hundred eighty eight individual chips having said second numerical values equate to one thousand two hundred points, wherein one hundred twenty first chips have a value of one point each, one hundred twenty second chips have a value of five points each, and forty-eight third chips have a value of ten points each.

12. The method of playing a board game set forth in claim 1, further characterized in that said first cards comprise four identical sets of ten cards, said ten cards illustrate said third numerical values from one to ten and there are six said wild cards making forty-six in total.

13. The method of playing a board game set forth in claim 1, further characterized in that said second cards are forty in total and illustrate said numerical range as 1-1, 1-2, 1-3, 1-4, 1-5, 1-6, 1-7, 1-8, 1-9, and 1-10.

* * * * *